US005178592A

United States Patent [19]

Yang

[11] Patent Number: 5,178,592

[45] Date of Patent: Jan. 12, 1993

[54] HYDRAULIC CYLINDER AND FOOT PLATE POSITIONING DEVICE

[76] Inventor: Li-Hsiang Yang, No. 22-3, Hao Chin Road, San Shen Village, Pu Yuan Hsiang Changhua, Taiwan

[21] Appl. No.: 892,027

[22] Filed: Jun. 2, 1992

[51] Int. Cl.[5] ..... A63B 22/04

[52] U.S. Cl. ..... 482/53; 482/908; 482/112

[58] Field of Search ..... 482/51, 52, 53, 111, 482/112, 113, 148, 56, 37, 908, 70, 73

[56] References Cited

U.S. PATENT DOCUMENTS 4,838,543 6/1989 Armstrong et al. ..... 482/53

5,054,770 10/1991 Bull ..... 482/53

*Primary Examiner*—Stephen R. Crow

*Attorney, Agent, or Firm*—Bacon & Thomas

[57] ABSTRACT

A connecting device comprising a inverted U-shaped holder plate mounted on a foot plate, which has a stub tube at the bottom inserted in either of a row of longitudinally aligned holes on the foot plate and two eyed lugs at the top to which a hydraulic cylinder is pivoted, a cam inserted in between two opposite vertical side walls of the holder plate and disposed below the foot plate, and a T-shaped key inserted through two polygonal through holes on the two opposite vertical side walls of the holder plate and a polygonal hole on the cam to connect the cam to the holder plate permitting the holder plate to be firmly retained to the foot plate, wherein rotating the T-shaped key in one direction causes the holder plate to be tightened to the foot plate; rotating the T-shaped key in the reverse direction causes the holder plate to be loosened from the foot plate.

1 Claim, 3 Drawing Sheets

FIG. 1-A
(PRIOR ART)

HYDRAULIC CYLINDER AND FOOT PLATE POSITIONING DEVICE

BACKGROUND OF THE INVENTION

1. Field of the Invention

The present invention relates to a hydraulic cylinder and foot plate connecting device for connecting a hydraulic cylinder to a respective foot plate on a foot training apparatus. The device comprises a substantially inverted U-shaped holder plate pivoted to a hydraulic cylinder and bridged over the foot plate, to which the hydraulic cylinder is to be connected, and secured in place by a T-shaped key and a cam.

2. Description of Prior Art

FIG. 1 illustrates an indoor gymnastic apparatus for training the muscles of the legs, in which each hydraulic cylinder (A1) is connected to a respective foot plate (A2) by a holder plate (A11) and a bolt (A13). The holder plate (A11) has a projecting plate (A12) inserted through a sliding slot (A21) on the foot plate (A2) and locked in place by the bolt (A13). The disadvantage of this hydraulic cylinder and foot plate positioning structure is that the holder plate (A11) may be loosened from the foot plate, more particularly after a long use, causing the hydraulic cylinder (A1) to vibrate during its reciprocating motion. Therefore, accidents or athletic injury may happen during the operation of the indoor gymnastic apparatus.

SUMMARY OF THE INVENTION

The present invention has been accomplished to eliminate the aforesaid disadvantage. According to one aspect of the present invention, a hydraulic cylinder and foot plate connecting device is generally comprised of a substantially inverted U-shaped holder plate mounted on a foot plate, which has two eyed lugs at the top to which a hydraulic cylinder is pivoted, a cam inserted in between two opposite vertical side walls of the holder plate and disposed below the foot plate, and a T-shaped key inserted through two polygonal through holes on the two opposite vertical side walls of the holder plate and a polygonal hole on the cam to connect the cam to the holder plate permitting the holder plate to be firmly retained to the foot plate. Therefore, rotating the T-shaped key in one direction causes the holder plate to be tightened to the foot plate; rotating the T-shaped key in the reverse direction causes the holder plate to be loosened from the foot plate. According to another aspect of the present invention, the holder plate has a stub tube at the bottom inserted in either of a row of longitudinally aligned holes on the foot plate, and therefore, the holder plate is prohibited from sliding on the foot plate once it has been fastened in place.

DETAILED DESCRIPTION OF THE DRAWINGS

Figure 1:
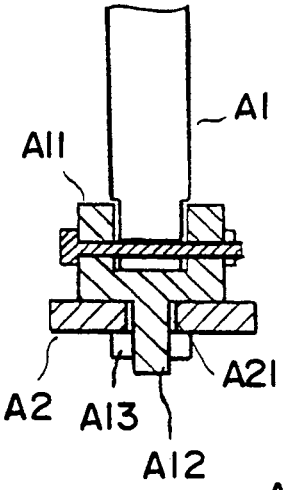
FIG. 1 (PRIOR ART)
Figure 1:
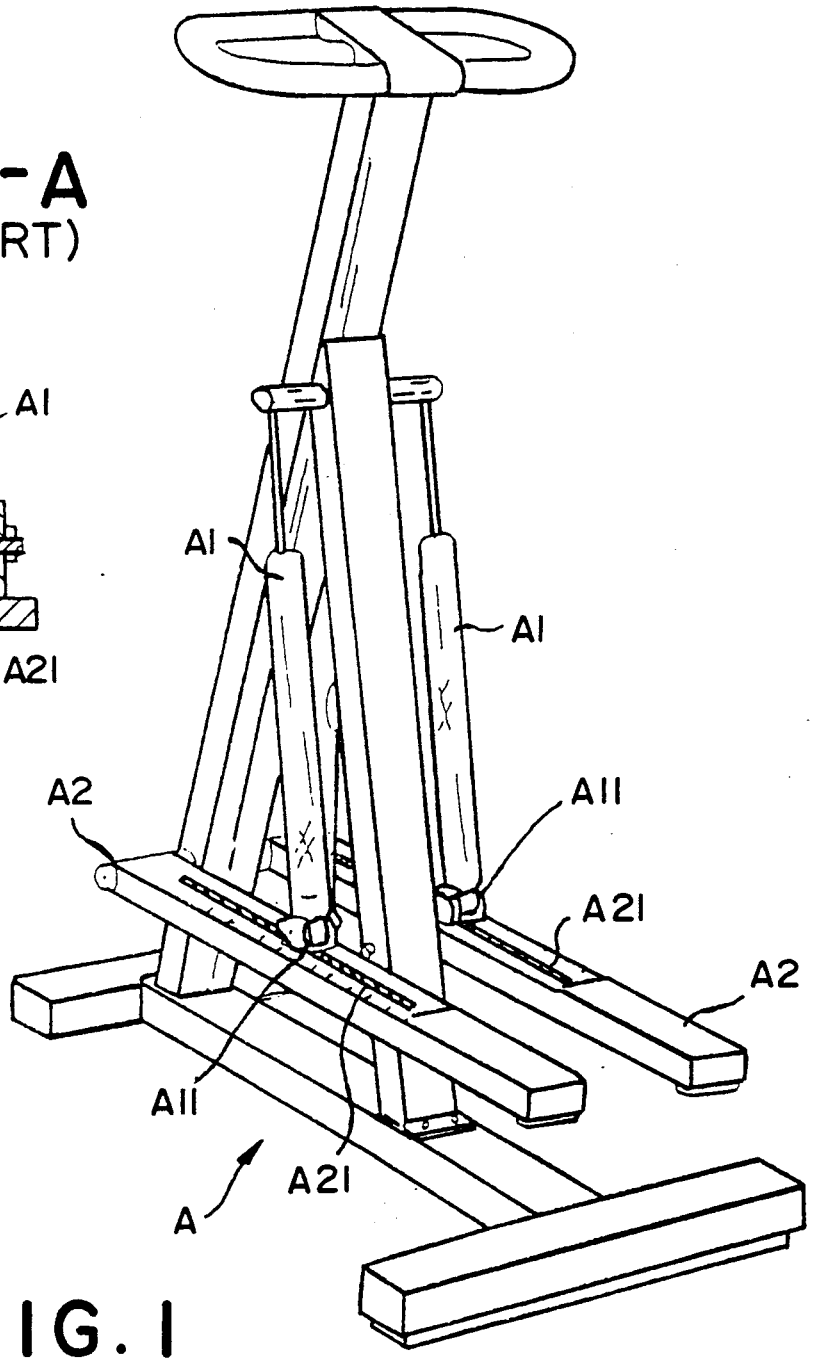
FIG. 1 (PRIOR ART)
Figure 2:
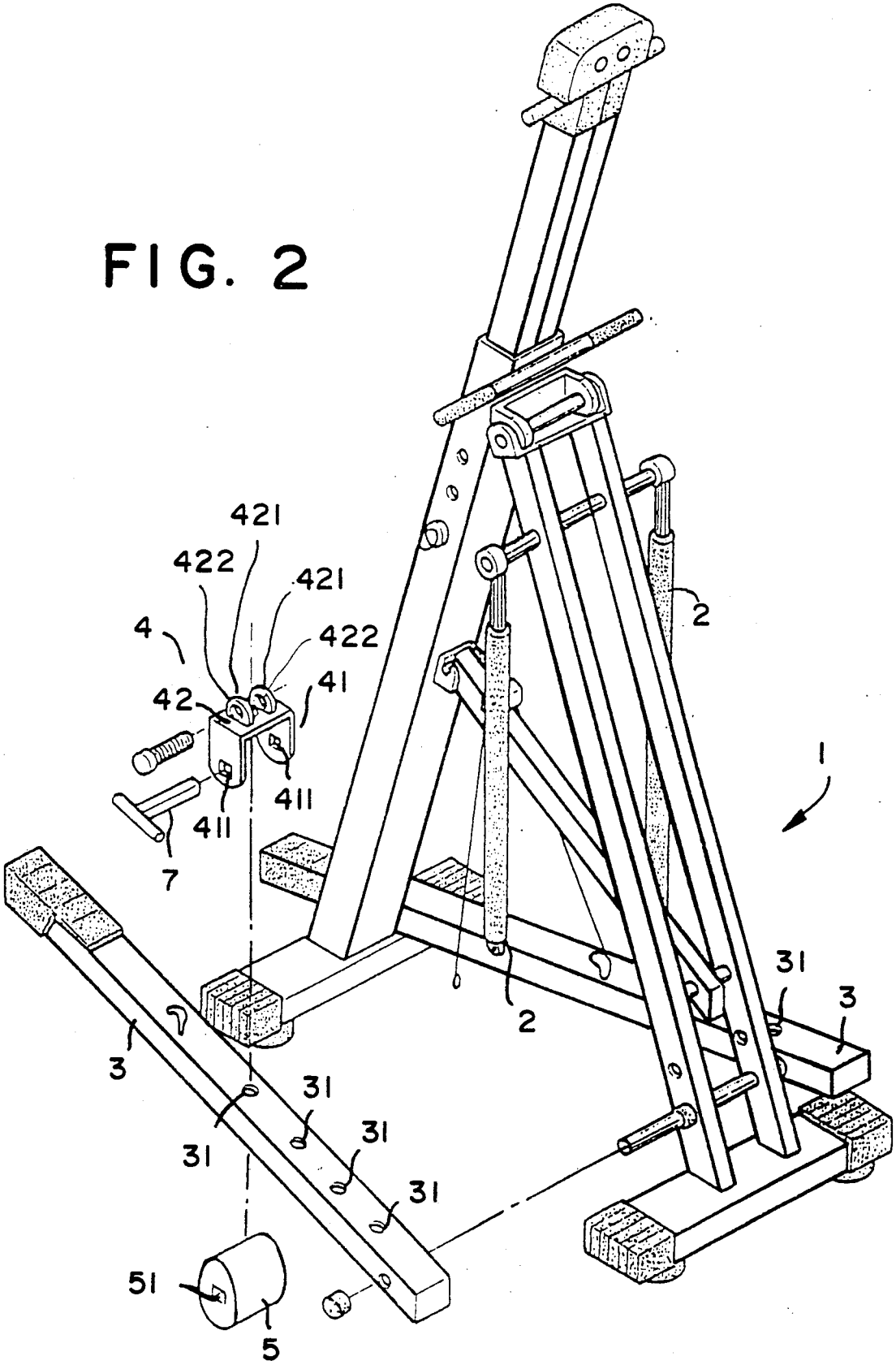
Figure 3:
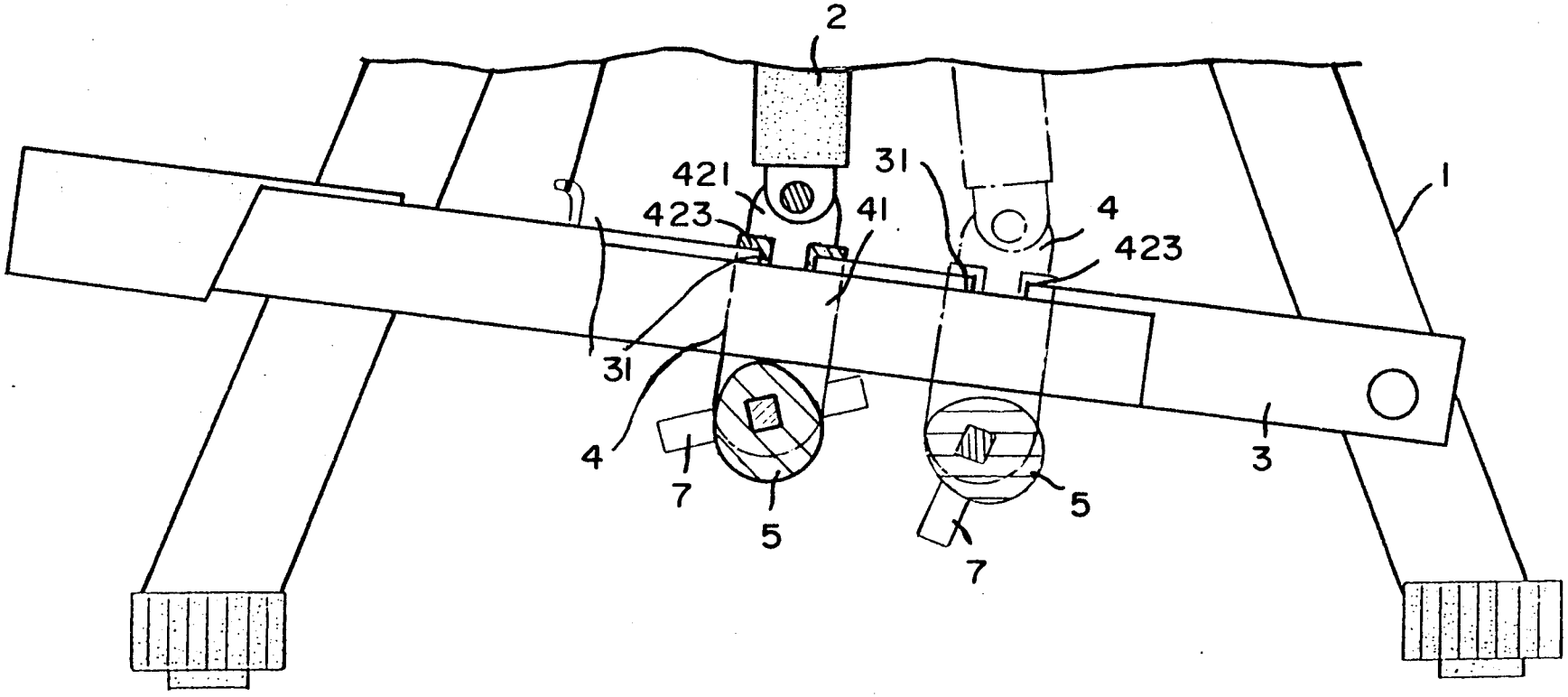

FIG. 1 is a perspective view of a foot training apparatus as constructed in accordance with the prior art;

FIG. 1-A is a cross sectional view taken on FIG. 1, showing the arrangement of the prior art hydraulic cylinder and foot plate connecting device;

FIG. 2 is a dismantled view of the preferred embodiment of the present invention; and FIG. 3 is a schematic plain view showing that rotating the T-shaped key in either direction causes the holder plate to be tightened to the foot plate or loosened therefrom.

DETAILED DESCRIPTION OF THE PREFERRED EMBODIMENT

Referring to FIG. 2, in a foot training apparatus 1, there is provided a hydraulic cylinder and foot plate connecting device at either side to connect a hydraulic cylinder 2 to a respective foot plate 3. The foot plate 3 has a row of positioning holes 31 longitudinally aligned on the top surface thereof. The connecting device is generally comprised of a substantially inverted U-shaped holder plate 4, a cam 5 and a T-shaped key 7. The holder plate 4 comprises two polygonal through holes 411 aligned on two opposite vertical side walls 41 thereof, two lugs 421 with holes 422 spaced on the top edge of a middle transverse wall 42 thereof for pivoting the hydraulic cylinder 2, and a stub tube 423 vertically extended downward from the middle transverse wall 42 at the center. The width between two opposite vertical side walls 41 shall be at least equal to the width of the foot plate 3, so that the foot plate 3 can be inserted into the space defined within the two opposite vertical side walls 41 during the assembly process of the apparatus. The sub tube 423 has an outer diameter slightly smaller than the inner diameter of the positioning holes 31. The cam 5 which has a narrow upper profile and a relatively wider lower profile comprises a polygonal hole 51 through the central axis thereof.

Referring to FIG. 3, after the holder plate 4 having been mounted on the foot plate 3 with the stub tube 423 inserted in either positioning hole 31, the hydraulic cylinder 2 is pivotably connected to the lugs 421, and then, the cam 5 is inserted in between the two opposite vertical side walls 41 below the foot plate 4 and secured in place by the T-shaped key 7. Rotating the T-shaped key 7 in one direction causes the holder plate 4 to be tightened to the foot plate 3; rotating the T-shaped key 7 in the reverse direction causes the holder plate 4 to be loosened form the foot plate 3 for changing the connecting position from one positioning hole 31 to another.

What is claimed is:

1. A hydraulic cylinder and foot plate connecting device for connecting a hydraulic cylinder of a foot training apparatus to a respective foot plate thereon, the device comprising:

a substantially inverted U-shaped holder plate mounted on said foot plate at the top, said holder plate comprising two polygonal through holes aligned on two opposite vertical side walls thereof, two eyed lugs on a middle transverse wall thereof at the top, to which said hydraulic cylinder is pivoted, and vertically extended downward from said middle transverse wall at the center and inserted in either of a row of longitudinally aligned positioning holes on said foot plate;

a cam fastened to said holder plate in between said two opposite vertical side walls and disposed below said foot plate, said cam comprising a polygonal hole through the central axis thereof aligned with the two polygonal through holes on said two opposite vertical side walls of said holder plate;

a T-shaped key comprising a polygonal rod inserted through the two polygonal through holes on said two opposite vertical side walls of said holder plate and the polygonal hole on said cam to connect said cam to said holder plate permitting said holder plate to be firmly retained to said foot plate; and wherein rotating said T-shaped key in one direction causes said holder plate to be tightened to said foot plate; rotating said T-shaped key in the reverse direction causes said holder plate to be loosened from said foot plate.

* * * * *